US008096784B2

(12) United States Patent
Sheen et al.

(10) Patent No.: US 8,096,784 B2
(45) Date of Patent: Jan. 17, 2012

(54) BI-DIRECTIONAL CONTINUOUS PERISTALTIC MICRO-PUMP

(75) Inventors: Jyh-Jong Sheen, Keelung (TW); Shang-Chian Su, Keelung (TW)

(73) Assignee: National Taiwan Ocean University, Keelung (TW)

( * ) Notice: Subject to any disclaimer, the term of this patent is extended or adjusted under 35 U.S.C. 154(b) by 944 days.

(21) Appl. No.: 12/103,927

(22) Filed: Apr. 16, 2008

(65) Prior Publication Data

US 2009/0263264 A1 Oct. 22, 2009

(51) Int. Cl.
*F04B 43/12* (2006.01)

(52) U.S. Cl. ..... 417/383; 417/394; 417/474; 137/829; 137/833; 137/863; 422/505

(58) Field of Classification Search ..... 417/383, 417/384, 392–395, 474; 137/829, 833, 830, 137/831, 863

See application file for complete search history.

(56) References Cited

U.S. PATENT DOCUMENTS 6,893,505 B2 * 5/2005 Peace ..... 118/506
7,143,785 B2 * 12/2006 Maerkl et al. ..... 137/597
7,258,774 B2 * 8/2007 Chou et al. ..... 204/450
7,494,555 B2 * 2/2009 Unger et al. ..... 156/60

* cited by examiner

*Primary Examiner* — Devon C Kramer
*Assistant Examiner* — Ryan Gatzemeyer

(57) ABSTRACT

A bi-directional continuous peristaltic micro-pump is described. The micro-pump comprises: a substrate, an actuating mechanism and a fluid channel. The actuating mechanism comprises: a first slanted membrane the thickness of which increases progressively from left to right, a first chamber formed between the first slanted membrane and the substrate; and a second slanted membrane, the thickness of which decreases progressively from left to right, the second slanted membrane being located to the first slanted membrane's right side and parallel to the first slanted membrane with a space between the two membranes, a second chamber formed between the second slanted membrane and the substrate. By inflating the first chamber and the second chamber, the first slanted membrane and the second slanted membrane generate a continuous sweeping motion to force the working fluid to flow.

18 Claims, 7 Drawing Sheets

BI-DIRECTIONAL CONTINUOUS PERISTALTIC MICRO-PUMP

FIELD OF INVENTION

The present invention relates to a peristaltic micro-pump, and more particularly, to a bi-directional continuous peristaltic micro-pump.

BACKGROUND

Please refer to FIG. 1A, which is a diagram of a peristaltic micro-pump in the prior art. The peristaltic micro-pump, in the prior art, employs at least two pieces of flat membrane to generate discrete peristaltic motion and thus to pump a flow.

The advantages of using pneumatic pressure as the driving force are: the device is easily manufactured, low in power consumption, and the driving gas is easily obtained. The discrete pneumatic peristaltic micro-pump needs at least two membranes, while each membrane needs an electro-magnetic valve as the pneumatic pressure switch. The membranes will move up and down according to the supply and release of the pneumatic pressure, which makes it act like a pump. Due to the fact that the membrane is flat, when it moves up the working fluid will be compressed. The compressed working fluid is forced into two equal portions, in which one portion flows to one direction, while the other one flows to the opposite direction. In other words, only half of the working fluid will flow in the desired direction.

Therefore, the prior art has the problem of low fluid pumping efficiency.

SUMMARY

In view of this problem, the present invention provides a bi-directional continuous peristaltic micro-pump comprising: a substrate, an actuating mechanism and a fluid channel. The actuating mechanism comprises: a first slanted membrane, the thickness of which increases progressively from left to right, a first chamber is formed between the first slanted membrane and the substrate; and a second slanted membrane, the thickness of which decreases progressively from left to right, the second slanted membrane located to the right of the first membrane, parallel to the first slanted membrane with a spacing between the first and the second slanted membrane. A second chamber is formed between the second slanted membrane and the substrate. Further, the actuating mechanism connects with the substrate, and the fluid channel is arranged across the first and the slanted membrane.

In the present invention, the first slanted membrane bulges from left to right in sequence and forces the working fluid to flow to the right; and the second slanted membrane bulges from right to left in sequence and forces the working fluid to flow to the left.

In each cycle in the present invention, at least two thirds of the squeezed working fluid flows to the desired direction, in contrast with only half in the prior art. The present invention thus demonstrably improves fluid pumping efficiency.

The preferred embodiments and effects related to the present invention will be described in detail with the following figures.

BRIEF DESCRIPTION OF THE DRAWINGS

The following detailed description of the embodiments of the present invention can be best understood when read in conjunction with the following drawings, in which device parts are identified with reference numerals and in which.

DETAILED DESCRIPTION

Figure 1:
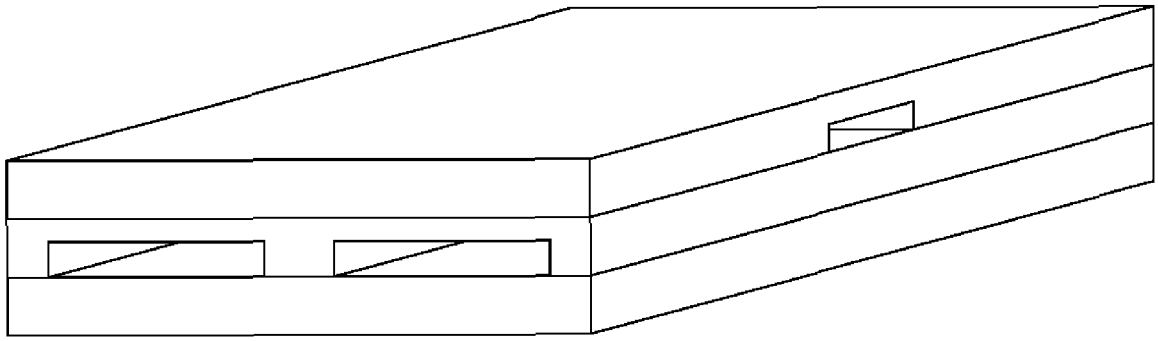
Fig.1 (Prior Art)
FIG. 1 is a peristaltic micro-pump diagram in the prior art.
Figure 2:
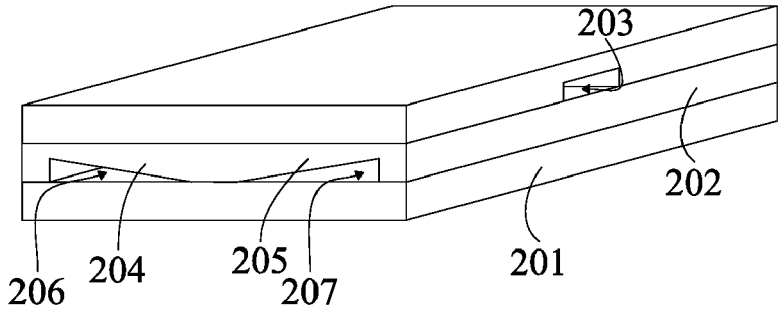
FIG. 2 is the stereo diagram of the first embodiment.
Figure 3:
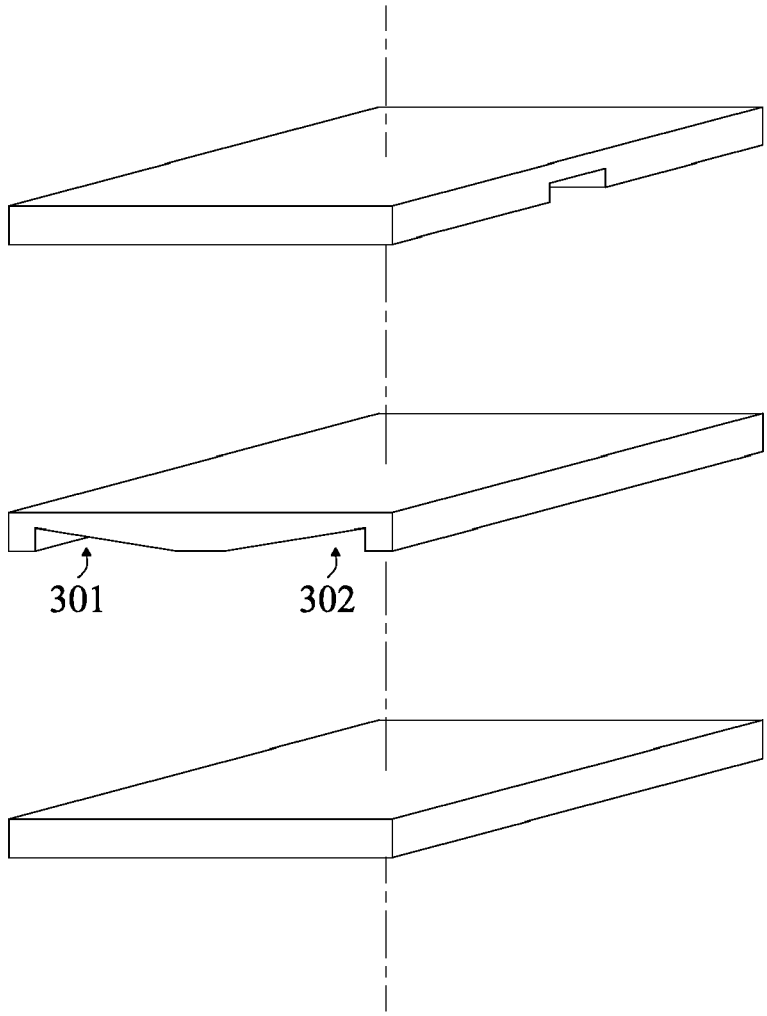
FIG. 3 is the exploded diagram of the first embodiment.

Please refer to FIG. 2 and FIG. 3, which are the stereo diagram and the exploded diagram of the first embodiment respectively. The first embodiment comprises: a substrate 201, an actuating mechanism 202 and a fluid channel 203. The actuating mechanism 202 comprises: a first slanted membrane 204, the thickness of which increases progressively from left to right, a first chamber 206 is formed between the first slanted membrane 204 and substrate 201, the bottom of said first chamber is a first opening 301; and a second slanted membrane 205, the thickness of which decreases progressively from left to right, the second slanted membrane 205 located to the first membrane 204's right side and parallel to the first slanted membrane 204 with a space between the membranes, a second chamber 207 is formed between the second slanted membrane 205 and the substrate 201, the bottom of said second chamber is a second opening 302. Further, actuating mechanism 202 is connected to the substrate 201 and fluid channel 203 is arranged across the first slanted membrane 204 and the second slanted membrane 205.

Mass production of the actuating mechanism 202 can be achieved by molding techniques. The first step is to make a mold of the actuating mechanism 202, then pour the liquid raw material into the mold of the actuating mechanism 202. The raw material of the actuating mechanism 202 is selected from the group consisting of polydimethylsiloxane (PDMS), polyurethane (PU), silica gel and rubber, while polydimethylsiloxane (PDMS) is the selection in the first embodiment.

The actuating mechanism 202 is removed from the mold when it has solidified completely. The first slanted membrane 204 and the second slanted membrane 205 are then produced. The actuating mechanism 202, manufactured by molding techniques, has the first opening 301 and the second opening 302 beneath the first chamber 206 and the second chamber 207. After the actuating mechanism 202 is connected to the substrate 201, the first opening 301 and the second opening 302 will be bonded by the substrate 201.

Figure 4:
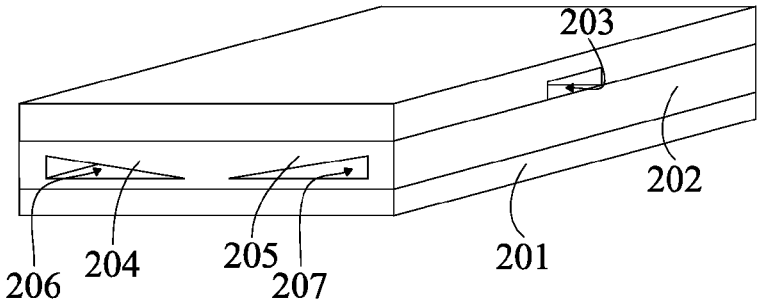
FIG. 4 is the stereo diagram of the second embodiment.
Figure 5:
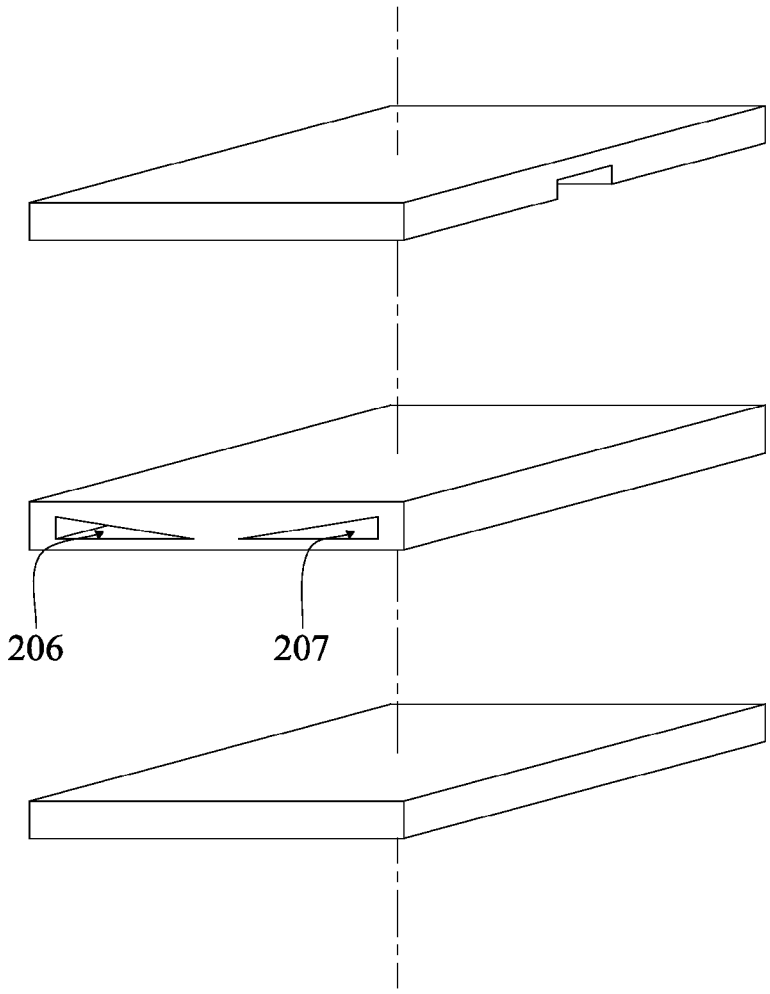
FIG. 5 is the exploded diagram of the second embodiment.

Please refer to FIG. 4 and FIG. 5, which are the stereo diagram and the exploded diagram of the second embodiment respectively. The difference between the second embodiment and the first embodiment is: there is no first opening 301 and second opening 302.

Figure 6:
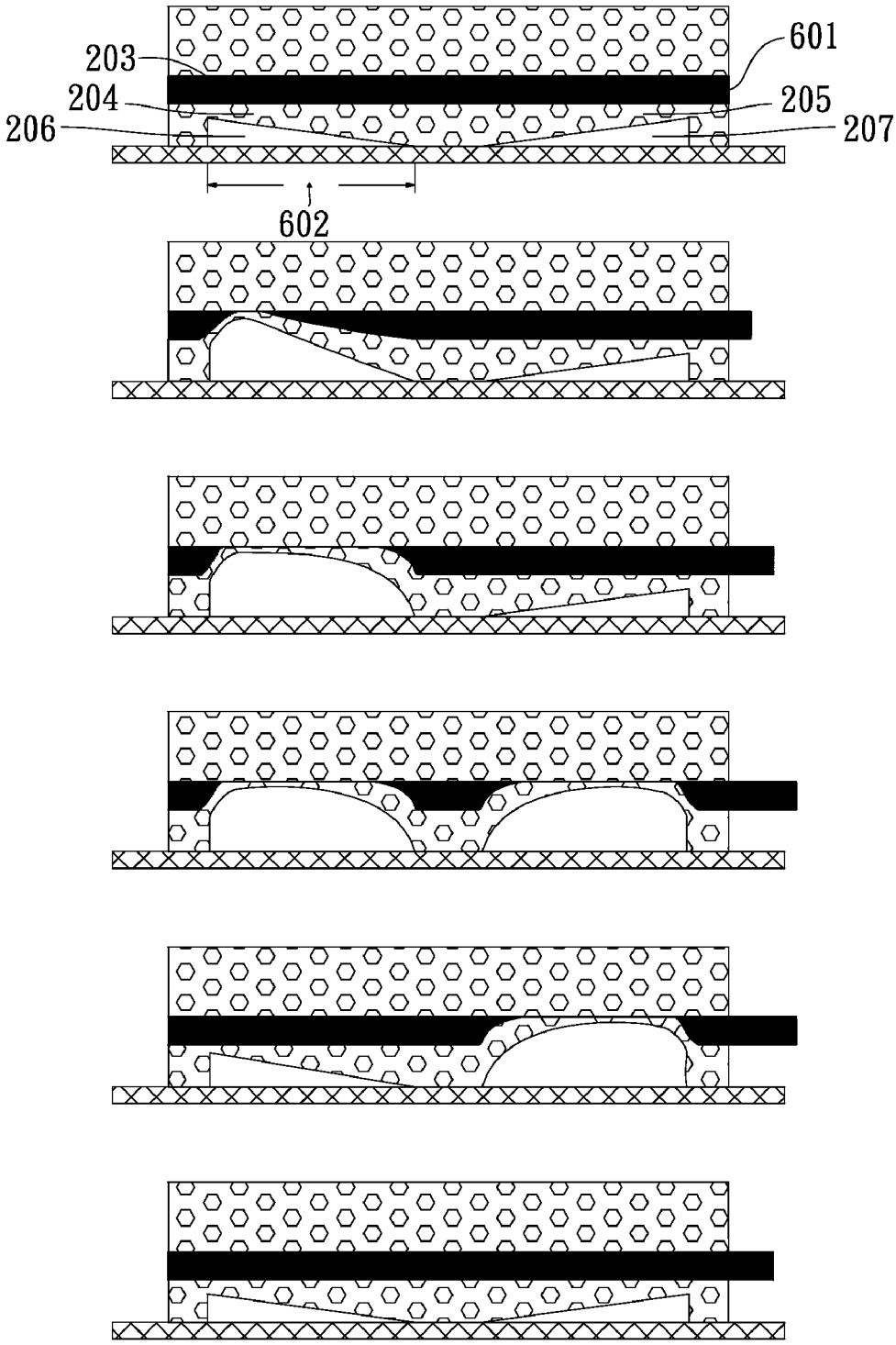
FIG. 6 is the operation diagram of the present invention.

Please refer to the FIG. 6, which is the operation diagram of the present invention. According to FIG. 6, a special case is described as below:

Assume the minimum and the maximum thickness of the first slanted membrane 204 and the second slanted membrane 205 are 30 μm and 50 μm respectively, and a width 602 thereof is 1000 μm; the height and the width 602 of the fluid channel 203 are 50 μm and 500 μm respectively; the individual volume of the working fluid 601 above the first slanted membrane 204 and the second slanted membrane 205 is V.

After inflating the first chamber 206 with an internal pressure of 10 psi, the first slanted membrane 204 will bulge from left to right in sequence and generate a continuous sweeping motion. As the first slanted membrane 204 touches the inner wall of the fluid channel 203, the distance between the contact point and the left-end of the first slanted membrane 204 is one third of the width of the first slanted membrane 204. Thus, as the first slanted membrane 204 comes into complete contact with the inner wall of the fluid channel 203, ⅔ V of the working fluid 601 will be forced to the right.

Next, the second chamber 207 is inflated with an internal pressure of 10 psi to make the second slanted membrane 205 bulge and come into complete contact with the inner wall of the fluid channel 203, meanwhile, ⅓ V of the working fluid 601 is forced to the right. At this moment, 1 V of the working fluid 601 has been forced to the right. In addition, the second slanted membrane 205, coming into full contact with the inner wall of the fluid channel 203, prevents working fluid 601 from flowing in the wrong direction.

The internal pressure of the first chamber 206 is then released, and the recovery of the deformation of the first slanted membrane 204 creates a vacuum to make the working fluid 601 at left flow in.

A cycle is completed after releasing the internal pressure of the second chamber 207 to recover the deformation of the second slanted membrane 205, in the meantime, ⅓ V of the working fluid 601 flows to the left. Therefore, ⅔ V of working fluid 601 is pumped each cycle.

In each cycle, ⅔ V of the working fluid 601 will be pumped by the present invention, as opposed to only ½ V by the prior art of two flat membranes with the same actuating fluid volume. The present invention thus demonstrably provides a continuous peristaltic pumping and a superior fluid pumping efficiency than the prior art.

Figure 7:
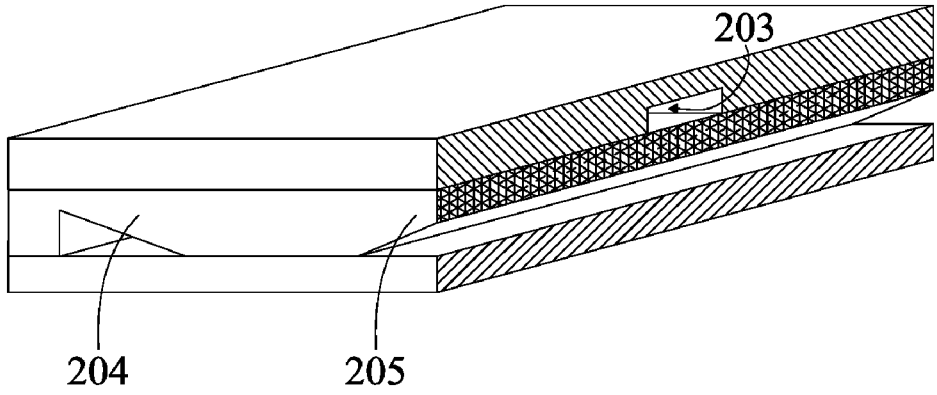
FIG. 7 is the sectional drawing of the second embodiment.

Please refer to FIG. 7, which is the sectional drawing of the second embodiment, revealing the interior structure of the fluid channel 203 and the second slanted membrane 205. The interior structure of the first slanted membrane 204 is the same as the second slanted membrane 205.

Figure 8:
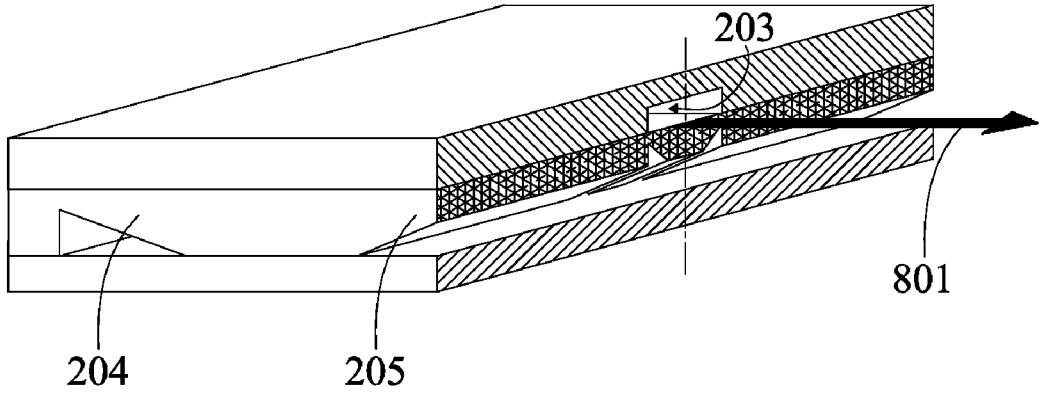
FIG. 8 is the sectional drawing of the third embodiment.

Please refer to FIG. 8, which is the sectional drawing of the third embodiment. The difference between the third and the second embodiment is: the thickness of the first slanted membrane 204 which is right beneath the fluid channel 203, decreasing progressively from the direction of the center axis 801 of fluid channel 203 to both sides thereof.

In the third embodiment (as compared with the second embodiment), the first slanted membrane 204 and the second slanted membrane 205 comes into contact with the inner wall of the fluid channel 203 and have better sealing with the inner wall of the fluid channel 203. Thus the fluid pumping efficiency is improved as a result.

Figure 9:
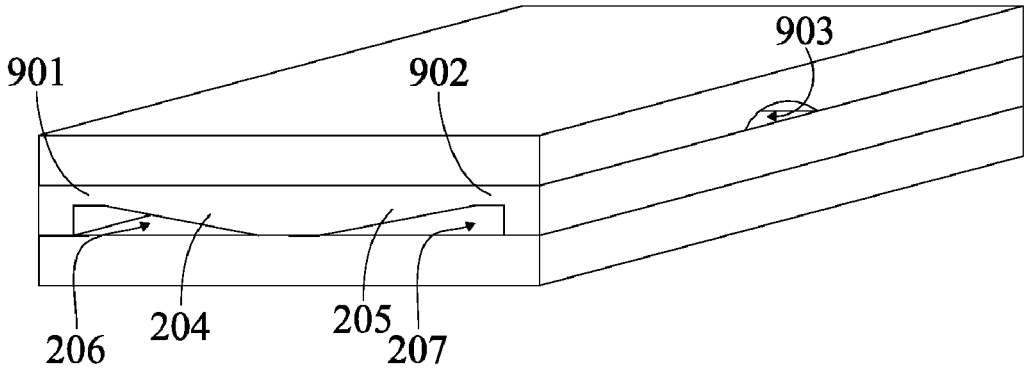
FIG. 9 is the stereo diagram (1) of the fourth embodiment.
Figure 10:
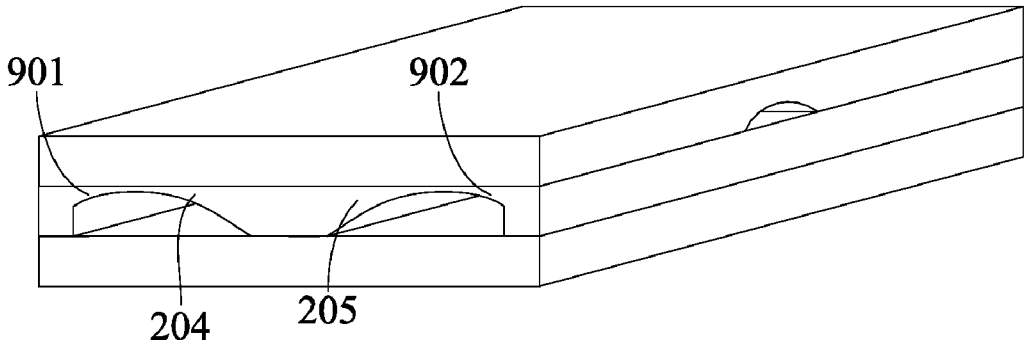
FIG. 10 is the stereo diagram (2) of the fourth embodiment.
Figure 11:
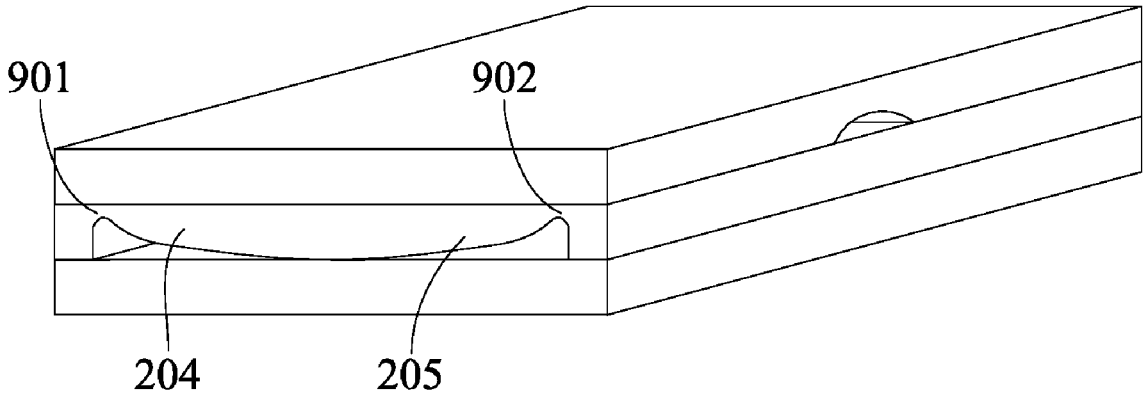
FIG. 11 is the stereo diagram (3) of the fourth embodiment.

Please refer to FIG. 9 through FIG. 11, which are the stereo diagrams (1), (2), (3) of the fourth embodiment respectively. The differences between the fourth embodiment and the above-mentioned embodiments are: the left side of the first slanted membrane 204 is connected with the right side of an auxiliary membrane 901, and the first chamber 206 is between the auxiliary membrane 901, first slanted membrane 204 and the substrate 201; the right side of the second slanted membrane 205 is connected with the left side of an auxiliary membrane 902, and the first chamber 207 is between the auxiliary membrane 902, second slanted membrane 205 and the substrate 201; and the cross-section of the fluid channel 203 is substantially semicircular.

Please refer to FIG. 9, where in the auxiliary membranes 901, 902 are flat.

Please refer to FIG. 10, where in the first slanted membrane 204, the second slanted membrane 205, and the auxiliary membranes 901, 902 are concave downward.

Please refer to FIG. 11, where in the first slanted membrane 204 and the second slanted membrane 205 are concave upward, and the auxiliary membranes 901, 902 are concave downward.

Through the auxiliary membrane 901, the distance between the contact point and the left side of the first slanted membrane 204 will be less than one third of the width of the first slanted membrane 204 when the first slanted membrane 204 bulges and comes into contact with the inner wall of fluid channel 203. Similarly, the auxiliary membrane 902 has the same effect on the second membrane 205. Consequently, the fluid pumping efficiency is improved by means of applying auxiliary membranes 901 and 902, In addition, the cross-section of the fluid channel 903 is substantially semicircular, which makes the first slanted membrane 204 and the second slanted membrane 205 have complete sealing with the inner wall of the fluid channel 203.

The technical contents of the present invention have been disclosed with preferred embodiments as above. However, the disclosed embodiments are not used to limit the present invention. Those proficient in the relevant fields could make slight changes and modification without departing from the spirit of the present invention, and the changes and modification made thereto are all covered by the scope of the present invention. The protection scope for the present invention should be defined with the attached claims.

What is claimed is:

1. A bi-directional continuous peristaltic micro-pump, comprising:

a substrate;

an actuating mechanism, connecting with said substrate, which comprises:

a first slanted membrane, the thickness of which increases progressively from left to right during a state of rest, wherein a first chamber is formed between said first slanted membrane and said substrate, arranged such that an increase in the internal pressure of said first chamber causes said first slanted membrane to bulge from left to right into an expanded state; and a second slanted membrane, the thickness of which decreases progressively from left to right during a state of rest, located to said first slanted membrane's right side and parallel to said first slanted membrane with a space between the two membranes, wherein a second chamber is formed between said second slanted membrane and said substrate, arranged such that an increase in the internal pressure of said second chamber causes said second slanted membrane to bulge from right to left into an expanded state; and a fluid channel for receiving a working fluid, said fluid channel arranged across said first slanted membrane and said second slanted membrane, arranged such that bulging of said first slanted membrane when said second slanted membrane is in a state of rest forces said working fluid to flow to the right.

2. The micro-pump of claim 1, wherein the bottom of said first chamber is a first opening and the bottom of said second chamber is a second opening, said first opening and said second opening both bonded by said substrate.

3. The micro-pump of claim 1, wherein said fluid channel has a channel width, the thickness of said first slanted membrane which is right beneath said fluid channel decreasing progressively from the direction of a center axis of said fluid channel to both sides thereof.

4. The micro-pump of claim 1, arranged such that bulging of said second slanted membrane after said first slanted membrane is in an expanded state prevents said working fluid from flowing back to the left when the first membrane is returned to a state of rest.

5. The micro-pump of claim 1, arranged such that bulging of said second slanted membrane when said first slanted membrane is in a state of rest forces said working fluid to flow to the left.

6. The micro-pump of claim 5, arranged such that bulging of said first slanted membrane after said second slanted membrane is in an expanded state prevents said working fluid from flowing back to the right when the second membrane is returned to a state of rest.

7. The micro-pump of claim 1, wherein said actuating mechanism further comprises:

an auxiliary membrane the right side of which is connected to the left side of said first slanted membrane, said first chamber being formed between said auxiliary membrane, said first slanted membrane and said substrate.

8. The micro-pump of claim 7, wherein the shape of said auxiliary membrane is flat.

9. The micro-pump of claim 7, wherein the shape of said auxiliary membrane is curved.

10. The micro-pump of claim 1, wherein said actuating mechanism further comprises:

an auxiliary membrane the left side of which is connected to the right side of said second slanted membrane, said second chamber is between said auxiliary membrane, said second slanted membrane and said substrate.

11. The micro-pump of claim 10, wherein the shape of said auxiliary membrane is flat.

12. The micro-pump of claim 10, wherein the shape of said auxiliary membrane is curved.

13. The micro-pump of claim 1, wherein the material of said substrate is selected from the group consisting of ceramic, metal, glass and polymer.

14. The micro-pump of claim 1, wherein the cross-section of said fluid channel is substantially rectangular.

15. The micro-pump of claim 1, wherein the cross-section of said fluid channel is substantially semicircular.

16. The micro-pump of claim 1, wherein the material of said fluid channel, said first slanted membrane and said second slanted membrane is selected from the group consisting of polydimethylsiloxane (PDMS), polyurethane (PU), silica gel and rubber.

17. The micro-pump of claim 1, wherein said first chamber has an asymmetrical cross-section that is a mirror image of the cross-section of said second chamber.

18. The micro-pump of claim 17, wherein the cross-sections of said first chamber and said second chamber are triangular.

* * * * *